US006910438B2

(12) United States Patent
Leverette et al.

(10) Patent No.: US 6,910,438 B2
(45) Date of Patent: Jun. 28, 2005

(54) OSCILLATION SUPPRESSION AND CONTROL SYSTEM FOR A FLOATING PLATFORM

(75) Inventors: Steven J. Leverette, Richmond, TX (US); Michael W. Spillane, Houston, TX (US); Oriol R. Rijken, Houston, TX (US); Stephen E. Kibbee, Houston, TX (US)

(73) Assignee: Seahorse Equipment Corporation, Houston, TX (US)

( * ) Notice: Subject to any disclaimer, the term of this patent is extended or adjusted under 35 U.S.C. 154(b) by 0 days.

(21) Appl. No.: 10/426,757

(22) Filed: Apr. 30, 2003

(65) Prior Publication Data

US 2004/0216657 A1 Nov. 4, 2004

(51) Int. Cl.[7] ..... B63B 35/44
(52) U.S. Cl. ..... 114/265; 114/293
(58) Field of Search ..... 114/264, 265, 114/213, 293, 125

(56) References Cited

U.S. PATENT DOCUMENTS 4,176,614 A * 12/1979 Goss et al. ..... 114/125
4,864,958 A * 9/1989 Belinsky ..... 114/265

* cited by examiner

*Primary Examiner*—Jesus D. Sotelo
(74) *Attorney, Agent, or Firm*—Nick A. Nichols, Jr.

(57) ABSTRACT

In accordance with the present invention, an oscillation suppression system is provided to inhibit vertical and rotational resonance of a floating platform. The oscillation suppression system includes energy absorption chambers mounted in or about the hull of the floating platform. The chambers may be separately attached or integrated as part of the structure. The chambers are comprised of gas in an upper portion, and water mass in a lower portion. The chambers are closed or partially vented at the upper ends and open at their bottom ends. The enclosed gas in the upper portion of the chamber acts as a gas spring reacting against the floating platform and the water mass. The suppression of resonant oscillations of the floating platform system is accomplished through the gas-spring pressure changes acting on the floating platform system in phase opposition to external forces.

29 Claims, 10 Drawing Sheets

FIG. 10
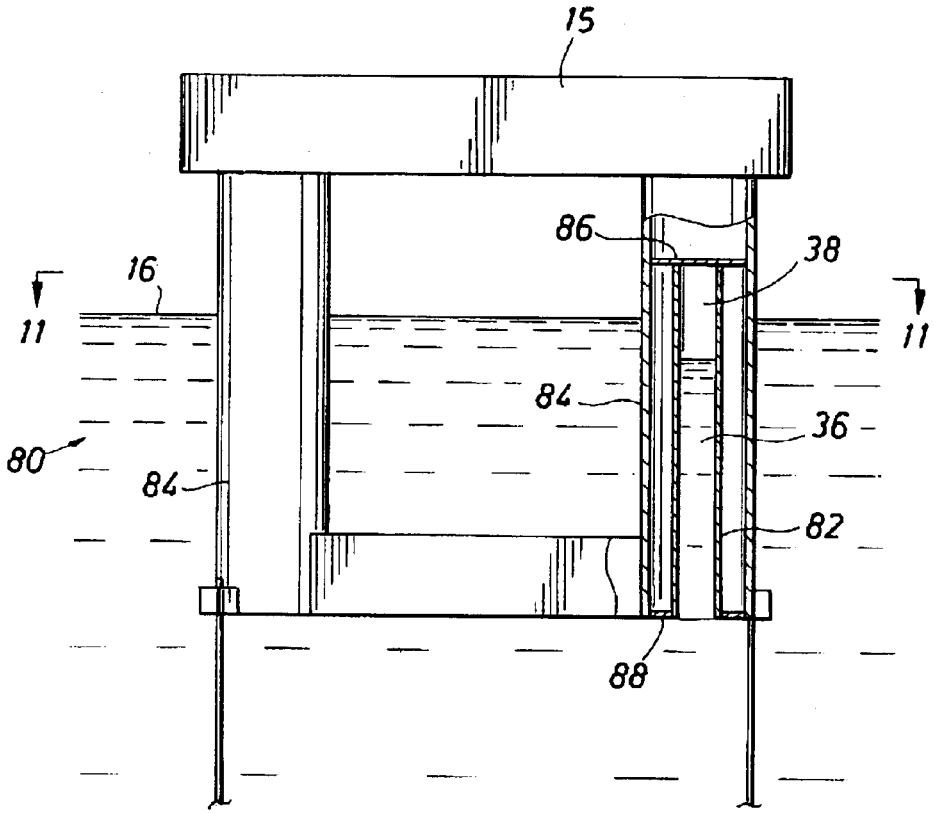
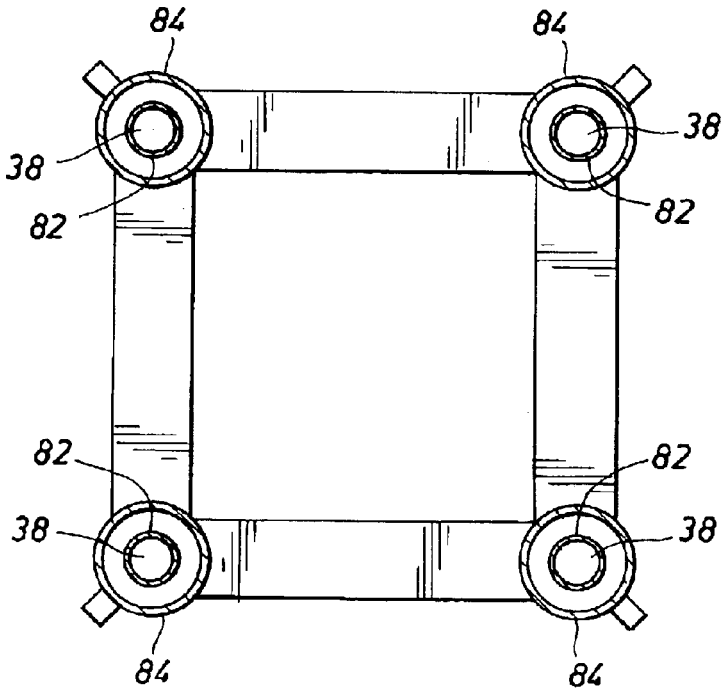
FIG. 11

OSCILLATION SUPPRESSION AND CONTROL SYSTEM FOR A FLOATING PLATFORM

BACKGROUND OF THE INVENTION

The present invention relates to resonant oscillation suppression systems for offshore floating platforms.

Tension Leg Platforms (TLPs) are floating platforms that are held in place in the ocean by means of vertical structural mooring elements called tendons, which are typically fabricated from high strength, high quality steel tubulars, and include articulated connections on the top and bottom (tendon connectors) that reduce bending moments and stresses in the tendon system. Many factors must be taken into account during the design of the tendon system to keep the TLP safely in place including: (a) limitation of stresses developed in the tendons during extreme storm events and while the TLP is operating in damaged conditions; (b) avoidance of any slackening of tendons and subsequent snap loading or disconnect of tendons as wave troughs and crests pass the TLP hull; (c) allowance for fatigue damage which occurs as a result of the stress cycles in the tendons system throughout its service life; (d) limit natural resonance (heave, pitch, roll) motions of the TLP to ensure adequate functional support for personnel, equipment, and risers; and (e) vibrations in the platform system arising from vortex-induced vibrations.

As water depth increases beyond about 4,000 ft, the TLP system cost begins to be driven by the cost of the tendon system due to the length and wall thickness of tendons and by fatigue considerations. To provide adequate platform motion control and to limit the amount of fatigue damage caused by each stress cycle, it has been thought necessary to limit the natural resonance periods of the TLP system (heave, pitch and roll) to the 3–4 second range by increasing the cross-sectional area of the tendon (i.e., by stiffening the "spring" since the "mass" of the platform is set mainly by operational considerations). The increasing requirement for more steel cross-sectional area in addition to length in deeper water causes the tendon system to become heavier, thus increasing the tendon cost and reducing the payload carrying capacity of the platform system, i.e. more and more platform buoyancy is 'consumed' merely supporting its own mooring system. This combination of increasing tendon length and tendon wall thickness causes the tendon system to dominate total installed cost of the entire TLP system in deepwater installations, i. e. beyond 6000 ft water depth.

It is therefore an object of the present invention to provide a floating platform system including a passive oscillation suppression system that inhibits resonant responses in the platform system leading to better motions for personnel, equipment and riser support, and to lighter and lower cost tendon systems.

SUMMARY OF THE INVENTION

In accordance with the present invention, an oscillation suppression system is provided to inhibit resonant oscillations of a floating platform. The oscillation suppression system includes energy absorbtion chambers that may be integrated into or be separately attached to the hull of the floating platform. The chambers are comprised of air (or other gas) in the upper portion, which may be closed or partially vented to the atmosphere, and water in the lower portion, which is open at the bottom. The enclosed air in the upper portion of the chamber acts as an air spring reacting between the floating platform and the water mass. Suppression of resonant oscillations of the floating platform is accomplished through air pressure variations in phase opposition to external forces on the floating platform. The dimensions of the chambers are chosen to produce natural periods of water mass oscillation near the resonant periods of the floating platform. Pressure changes result from changes in the air chamber volume caused by the vertical motion of the water mass relative to the floating platform.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings. It is noted, however, that the appended drawings illustrate only typical embodiments of this invention and are therefore not to be considered limiting of its scope, for the invention may admit to other equally effective embodiments.

FIGS. 10 is a partially broken away side view of a multi-column floating platform depicting the oscillation suppresion system of the present invention incorporated within the four support columns of the floating platform;

FIGS. 11 is a section view of the floating platform of the present invention taken along line 11—11 in FIG. 10;

DETAILED DESCRIPTION OF A PREFERRED EMBODIMENT

Figure 1:
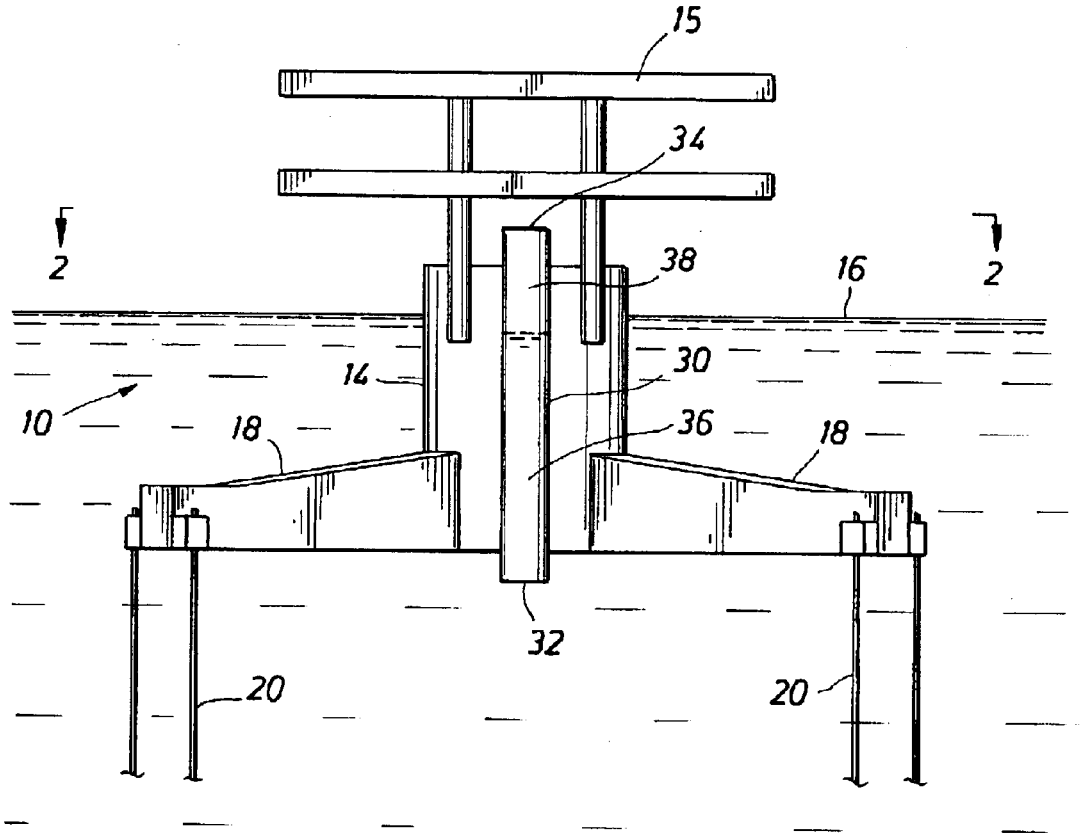
FIG. 1 is a side view of a mono-column floating platform depicting energy absorption chambers of the oscillation suppression system of the present invention attached to the hull of the floating platform.
Figure 2:
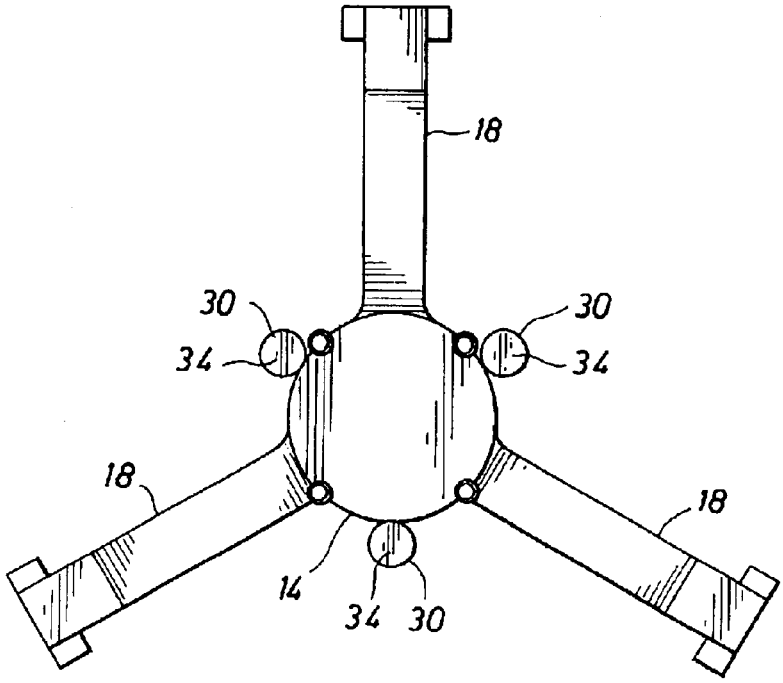
FIG. 2 is a section view of the floating platform of the present invention taken along line 2—2 in FIG. 1.

Referring first to FIG. 1, a mono-column hull floating platform generally identified by the reference numeral 10 is shown. The floating platform 10 includes a column or hull member 14 projecting above the water surface 16 supporting a platform deck 15 thereon. Pontoons 18 extend radially outward from the base of the hull 14. The floating platform 10 is anchored to the seabottom by tendons 20.

In a typical tendon design, steel tendons are utilized to secure the floating platform 10 to the seabottom. As exploration and production of oil reserves expand into deeper waters, the design of the tendon system becomes more critical and begins to dominate the platform costs. The tendon system must be designed to operate between tolerable minimum and maximum tensions, to restrict natural resonance motions, and to limit the fatigue damage caused by each stress cycle. The latter two are typically accomplished by increasing the cross-sectional area of the steel tendon, which increases the tendon axial stiffness. But this increases the weight of the tendon and reduces the payload carrying capacity of the platform 10.

Including an oscillation suppression system in the platform design may lessen the cost premiums associated with motion limiting and fatigue-driven tendon design. The oscillation suppression system inhibits vertical and rotational resonance in the tendon system by applying an out-of-phase force on the TLP system, compensating external forces.

Figure 18:
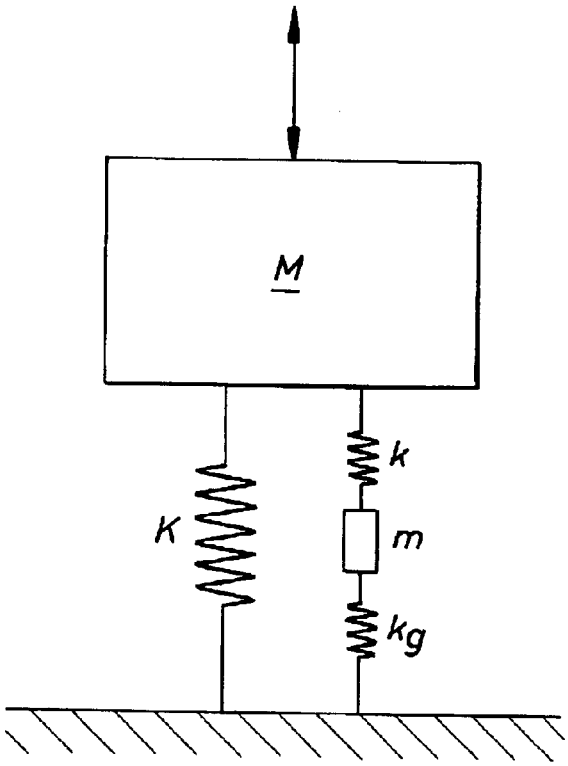
FIG. 18 is a schematic diagram representing a platform and the oscillation suppression system of the present invention.
Figure 19:
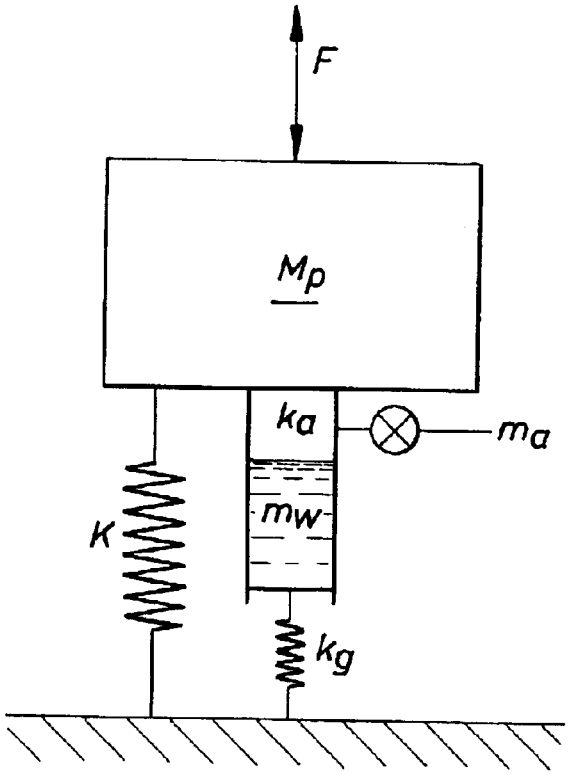
FIG. 19 is a schematic diagram representing the oscillation suppression system of the present invention including controlled venting means.

In accordance with the present invention, counteracting expected or unexpected vibrations in a platform system is accomplished by providing compensating forces through a tuned vibration absorber oscillation suppression system. The tuned vibration absorbing system is similar in function to such systems used to prevent vibrations in machinery or swaying of tall building structures, but in this application is composed of water masses and air springs. Referring to FIG. 18, the tuned oscillation suppression system of the present invention is conceptually similar to a two-degree-of-freedom oscillator pair, in which energy associated with a large mass-spring system, mass M, spring stiffness K, is naturally transmitted to a smaller mass-spring system, mass m, spring stiffness k. There is a supplementary spring $k_g$ which represents the hydrostatic restoring of the water level in the energy absorption chambers of the present invention, and which makes the solution somewhat different than the classic case. Referring to FIG. 19, in the present invention, the platform 10 is the large mass $M_P$, the tendons 20 are the large spring $K_P$, water in one or more energy absorption chambers acts as the smaller mass, $m_w$, and air in the upper portion of the energy absorption chambers acts as the smaller spring stiffness, $k_a$. Air flow $\dot{m}_a$ through a valve or throttle plate provides a damping effect to the air spring $k_a$. and is used to adjust the tuned oscillation suppression system damping.

In summary, the air-water chambers of the oscillation suppression system of the invention operate as parasitic mass-spring systems transferring energy from the floating platform to the water.

Specification of the oscillation suppression system is controlled by the requirement that the natural frequency of the vertical oscillation of the water mass in the chambers be near the natural frequency of the floating platform system. The oscillation suppression system's natural oscillation frequency depends on the ratio of the combined air-spring and water-column stiffness to the water-column mass. To maintain a fixed ratio between the oscillation suppression system's natural period and the floating system's natural period, changes in the stiffness and water mass of the oscillation suppression system must occur in the same proportion.

For the passive oscillation suppression system described herein, pressure changes result from changes in the air chamber volume caused by the vertical motions of the water mass relative to the floating platform. The net force from the pressure changes that acts on the floating platform is proportional to the aggregate waterline area of the oscillation suppression system. Individual oscillation suppression chambers should have small transverse dimensions compared to in-water column length to inhibit secondary, horizontal water mass displacements.

Increasing the in-water column length of the oscillation suppression system increases the water mass, reduces the relative influence of surface gravity waves within the chamber, and reduces the relative effects of the hydrostatic spring noted as $k_g$ above.

While it is theoretically possible in the absence of any damping in the tuned-oscillator to entirely negate resonant motions of the floating platform for a very narrow range of frequencies, in practice, exciting forces and responses are likely to occur over a relatively broad range of frequencies. With an oscillation suppression system, the resonant frequencies of each of the floating platform's vertical mode resonant responses are split into two distinct frequencies, shifting the resonance to higher and lower frequencies. External forcing at these new resonant frequencies, with low oscillation suppression system damping, will result in larger than desired resonant responses of the floating platform. With increased damping of the oscillation suppression system, the response near the original resonant frequency will increase, but the response at the new resonant peaks will diminish. An optimal damping can be found that minimizes the maximum response of the floating platform over all frequencies.

Referring again to FIG. 1, the platform 10 of the invention is provided with one or more energy absorption chambers secured on the hull 14 of the platform 10. In the configuration shown in FIG. 1, the energy absorption chambers comprise three cylinders 30 equally spaced about the hull 14. The cylinders 30 include an open bottom end 32 and a closed or partially vented upper end 34. The cylinders 30 are partially filled with a water mass 36. The upper portion of the cylinders 30 is filled with air or other gas, which forms an air spring 38. The water mass 36 oscillates vertically against the air spring 38 within the cylinders 30 and thereby inhibits resonant oscillations of the platform 10.

Figure 3:
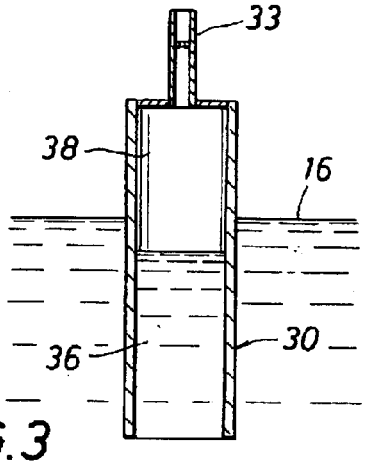
FIG. 3 is a section view of an energy absorption chamber of the present invention.
Figure 4:
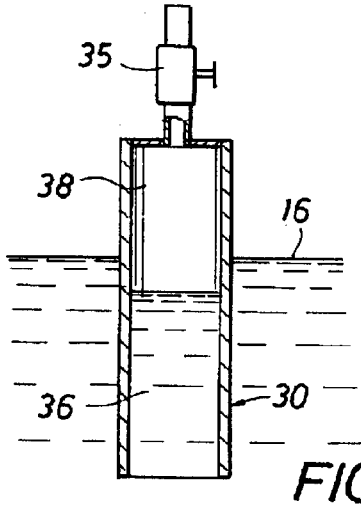
FIG. 4 is a section view of an energy absorption chamber of the present invention depicting valve venting means thereon.

FIGS. 3 and 4 show a means of damping of the oscillation suppression system of the invention without frictional or hydrodynamic drag forces acting on the water mass in the cylinders 30. By controlled venting of air through an orifice 33 or a control valve 35, it is possible to damp the oscillation suppression system of the platform 10 and to remove large energy pulses from the system before the occurrence of large platform resonant oscillations and their associated high tendon stresses.

Figure 5A:
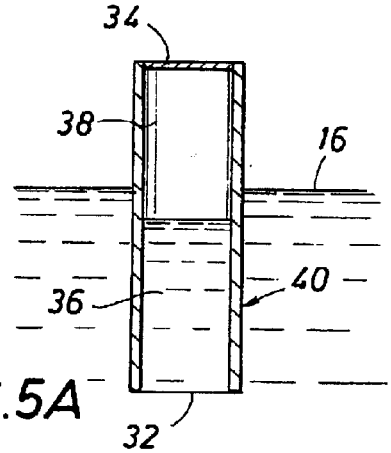
FIGS. 5A–5F are section views of alternate embodiments of energy absorption chambers of,the present invention.
Figure 5B:
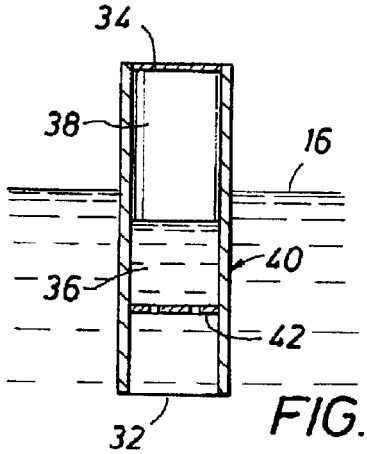
Figure 5C:
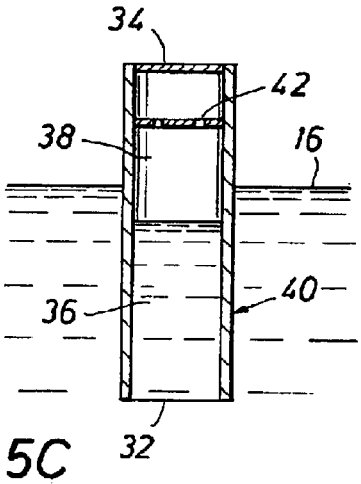
Figure 5D:
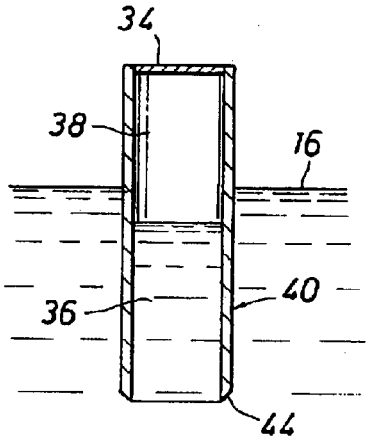
Figure 5E:
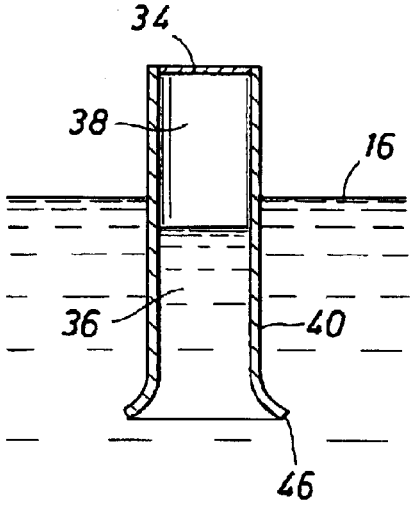
Figure 5F:
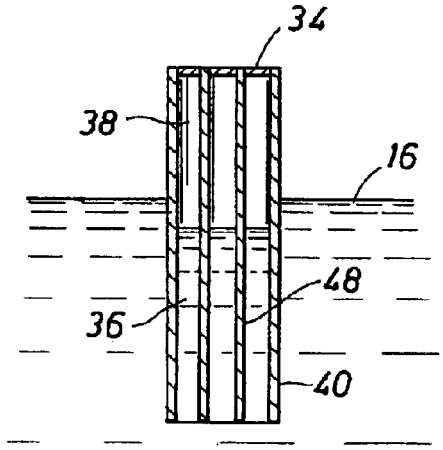

Various energy absorption chamber configurations may be utilized for increasing or decreasing the turbulence of the flow within the energy absorption chambers to vary the energy absorption characteristics of the oscillation suppression and control system of the platform 10. FIGS. 5A–5F illustrate several embodiments of energy absorption chambers. In FIG. 5A the energy absorption chamber is a cylinder 40 having an open bottom and a closed top. The energy absorption cylinders 40 may include a screen or baffle plates 42 in the water mass portion (FIG. 5B) or in the air mass portion (FIG. 5C) of the cylinders 40. Screens or baffle plates may also be incorporated in both the air and water mass portions of the cylinders 40. In FIG. 5D the cylinder 40 includes a sharp lower end 44 and in FIG. 5E the lower end 46 of the cylinder 40 provides a smooth flared entry into the bottom of the cylinder 40. In FIG. 5F, the cylinder 40 includes pipe 48 concentrically mounted within the cylinder 40 to control sloshing and to provided additional damping surfaces. The energy absorption characteristics of the oscillation suppression and control system of the invention may also be adjusted by shortening or lengthening the water mass portion and/or the air mass portion of the energy absorbing cylinders 40. However, excessive hydrodynamic or frictional damping of the water mass may render the oscillation suppression system ineffective and should be avoided.

Figure 6A:
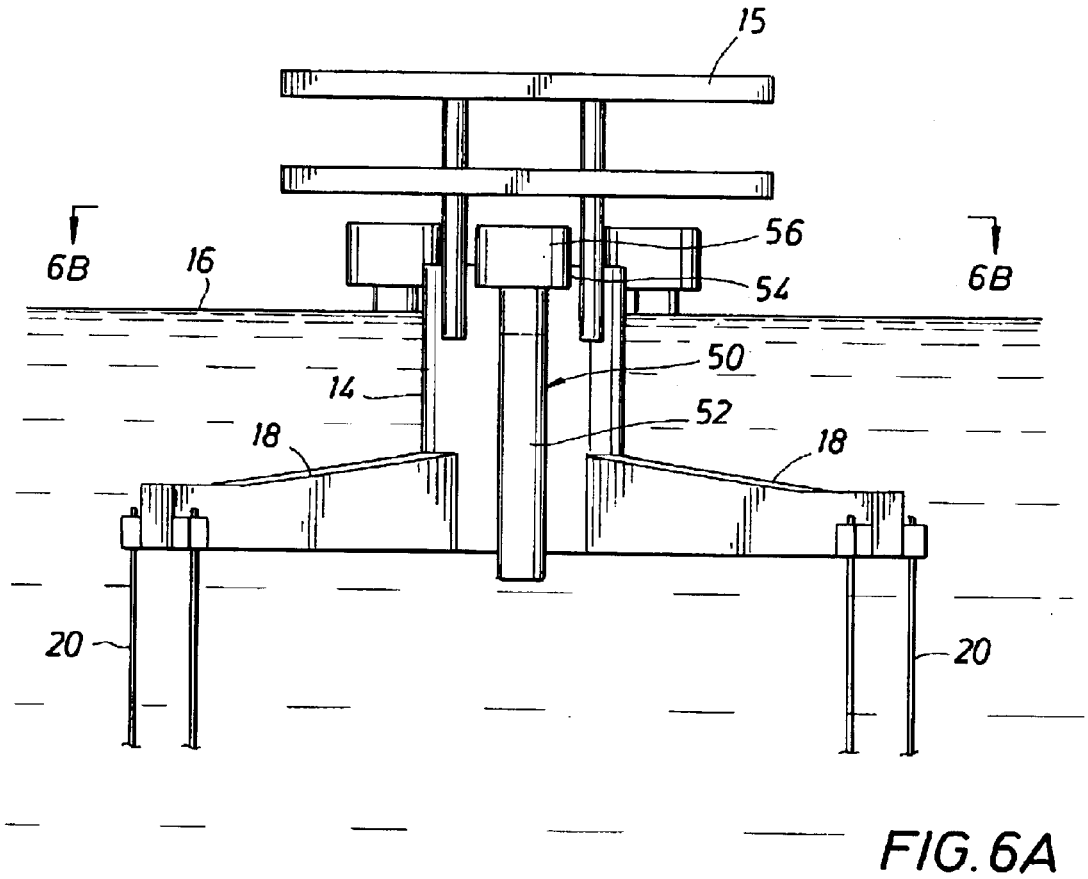
FIGS. 6A is a side view of a mono-column floating platform depicting stepped diameter energy absorption chambers of the present invention secured to the hull of the floating platform.
Figure 6B:
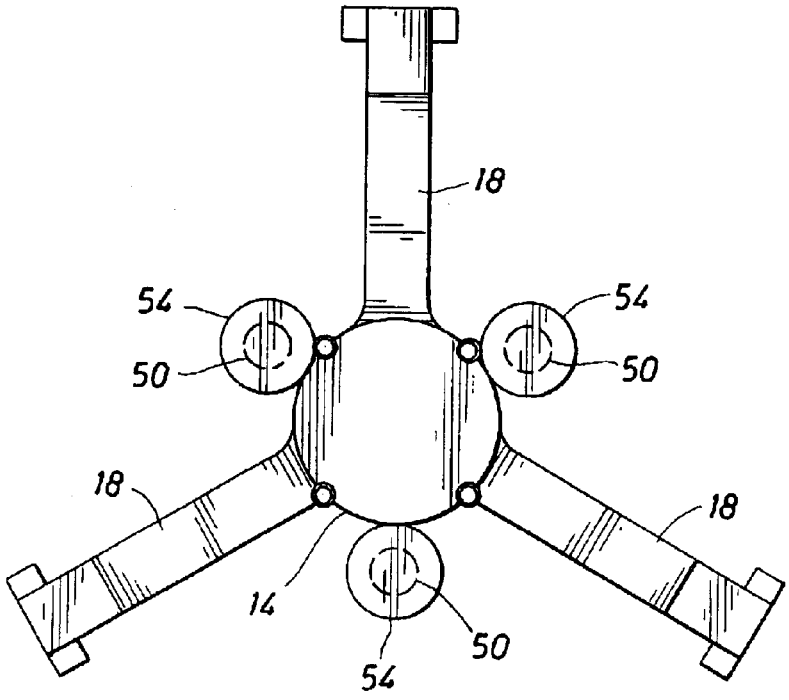
FIG. 6B is a section view of the floating platform of the present invention taken along line 6B—6B in FIG. 6A.

Referring now to FIGS. 6A and 6B, the oscillation suppression system of the invention comprises energy absorbing chambers 50 mounted about the hull 14 of the platform 10. The chambers 50 are stepped diameter cylinders including a lower portion 52 having a diameter less than the diameter of an upper portion 54. Trapped air in the upper portion 54 forms an air spring 56. The stepped diameter configuration of the energy absorbing chambers 50 permits the platform designer the flexibility to limit the height of the energy absorbing chambers 50 while still controlling the volume of the air spring 56. While the diameter of the water portion 52 is preferably constant for a particular design, flexibility is provided by altering the size and shape of the air spring 56 and thereby changing the volume of the upper portion 54 of the energy absorbing chambers 50 for fine tuning the oscillation suppression system of the invention. Fine tuning of the oscillation suppression system may also be accomplished by increasing the diameter of the lower portion 52 rather than the upper portion 54 of the energy absorbing chambers 50.

Figure 7:
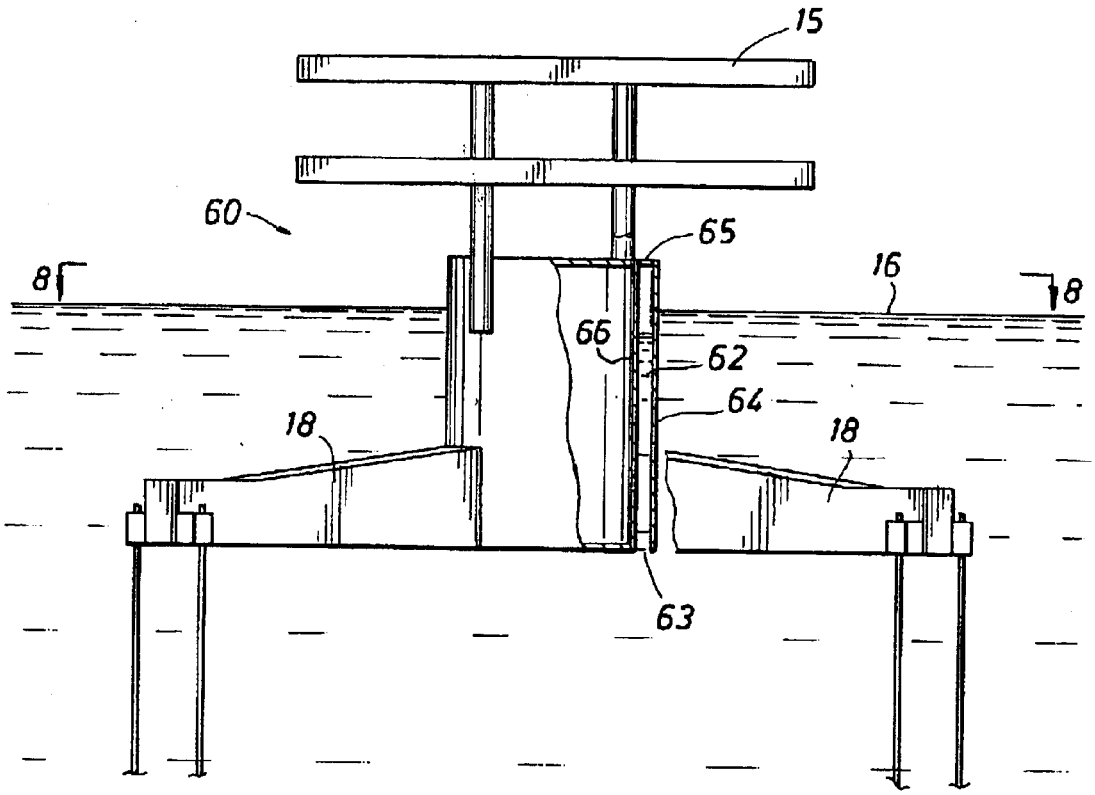
FIG. 7 is a partially broken away side view of a mono-column floating platform depicting an annular energy absorption chamber of the oscillation suppression system of the present invention incorporated in the hull of the floating platform
Figure 8:
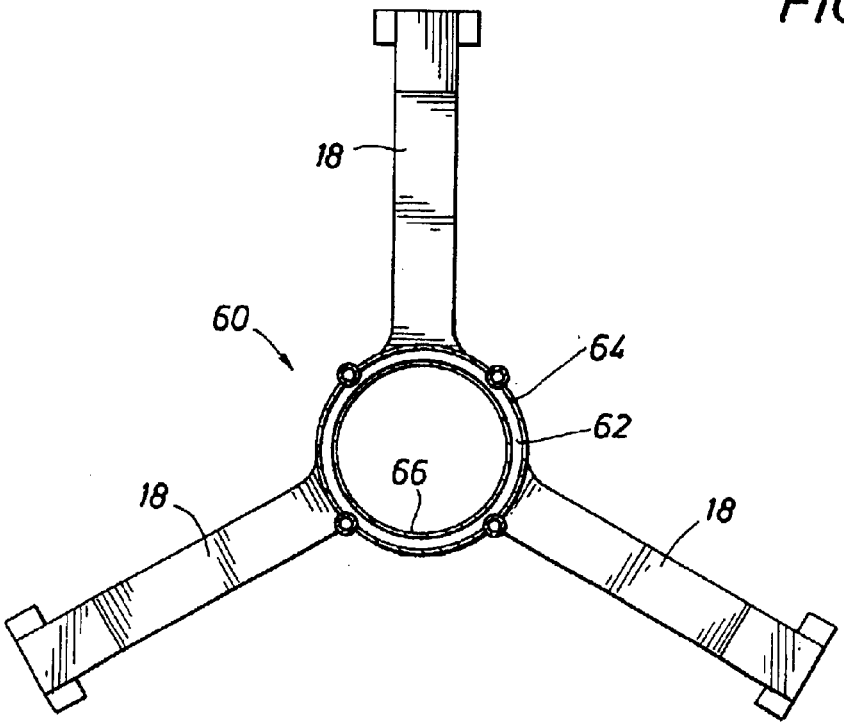
FIG. 8 is a section view of the floating platform of the present invention taken along line 8—8 in FIG. 7.
Figure 12:
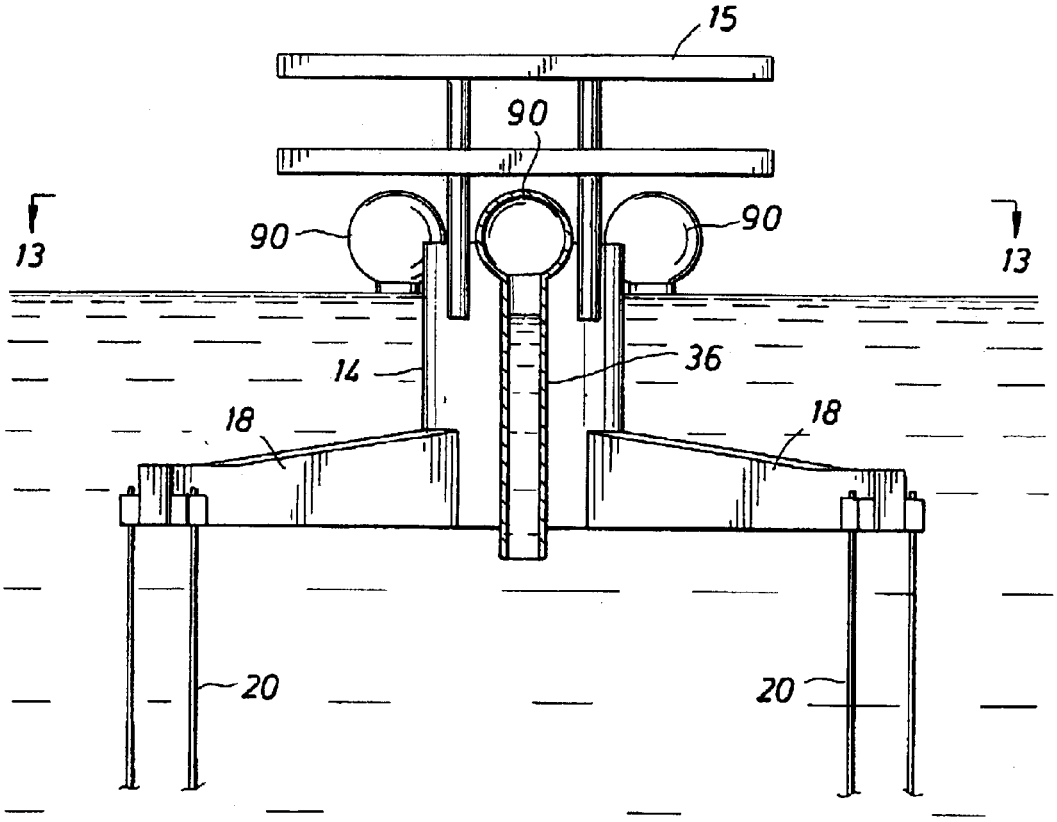
FIGS. 12–17 are side and section views depicting alternate embodiments of the oscillation suppression system of the present invention.
Figure 13:
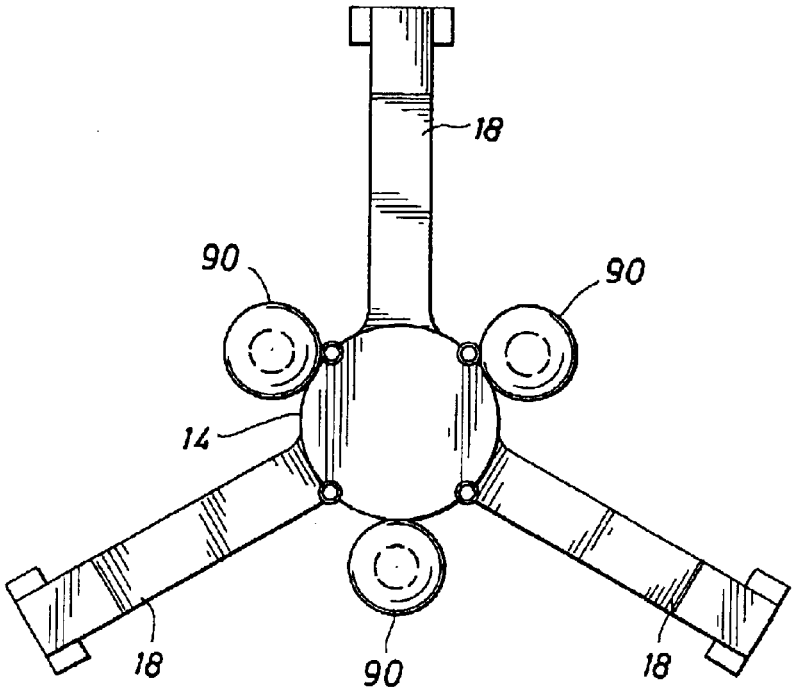
Figure 14:
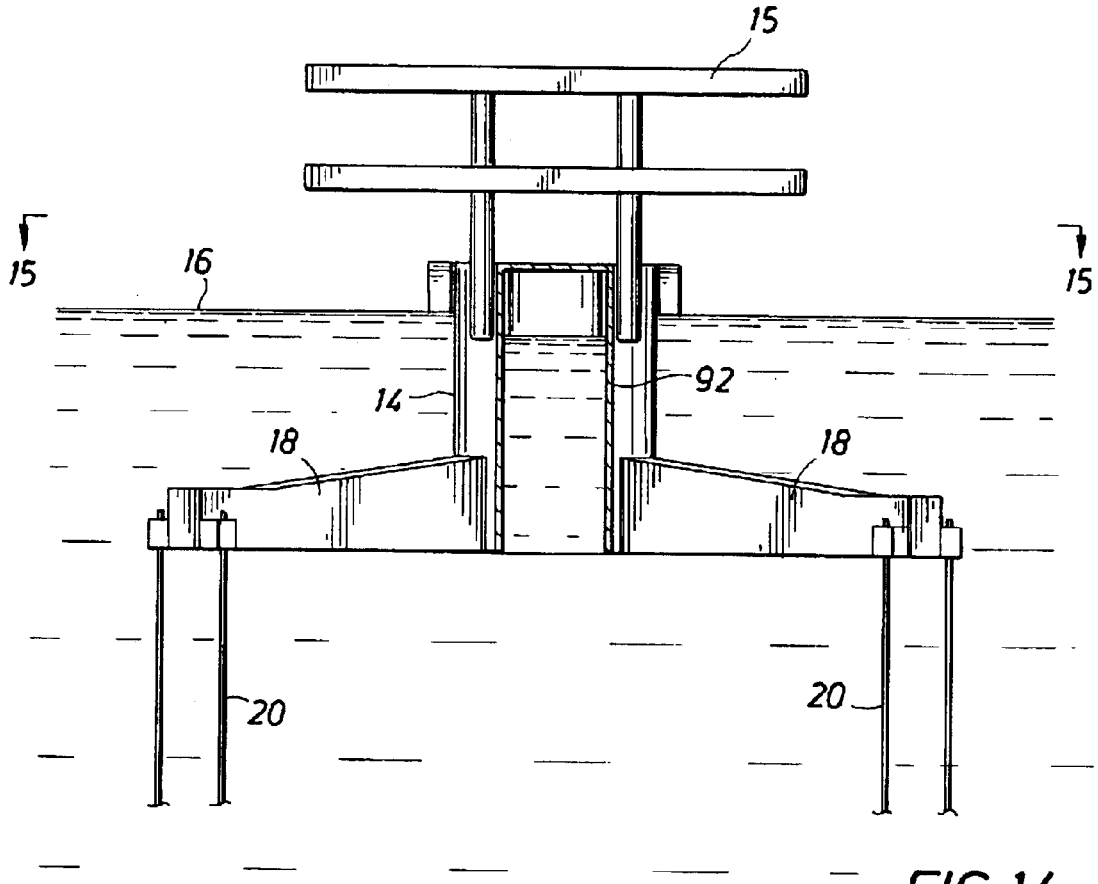
Figure 15:
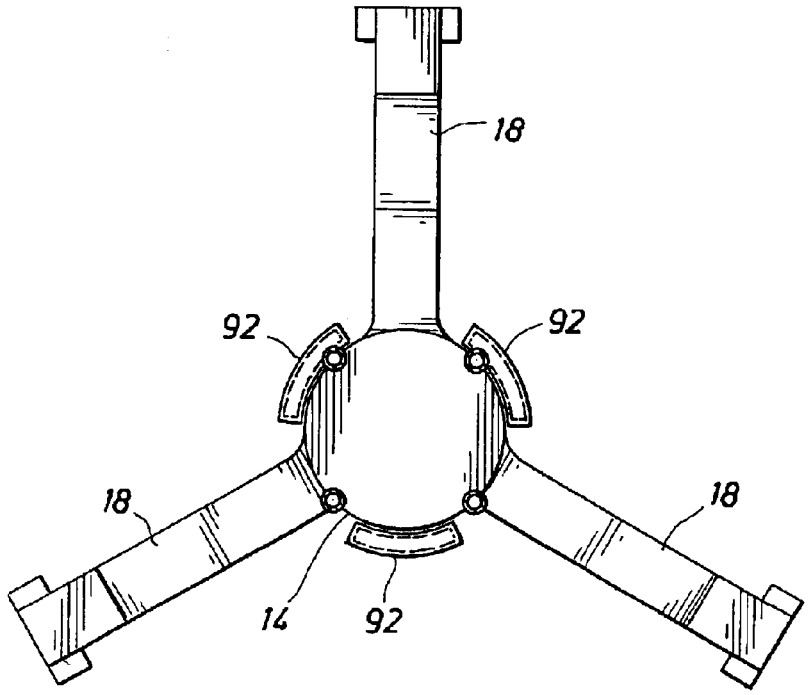
Figure 16:
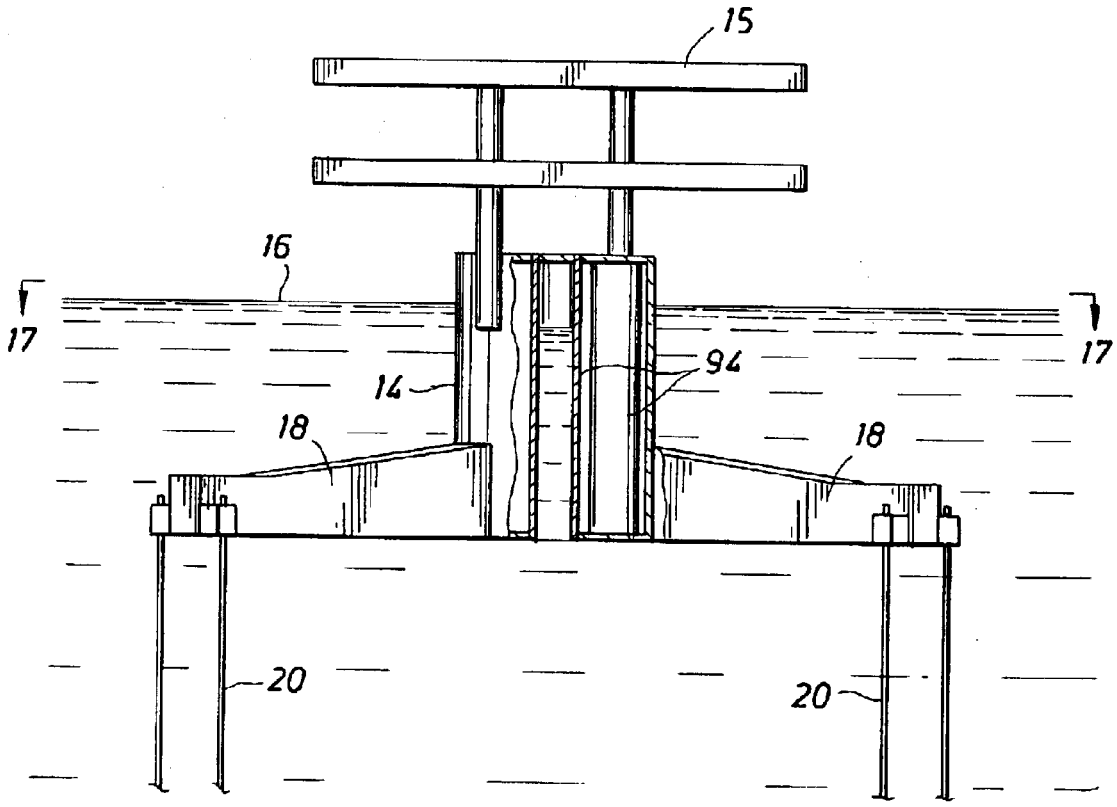
Figure 17:
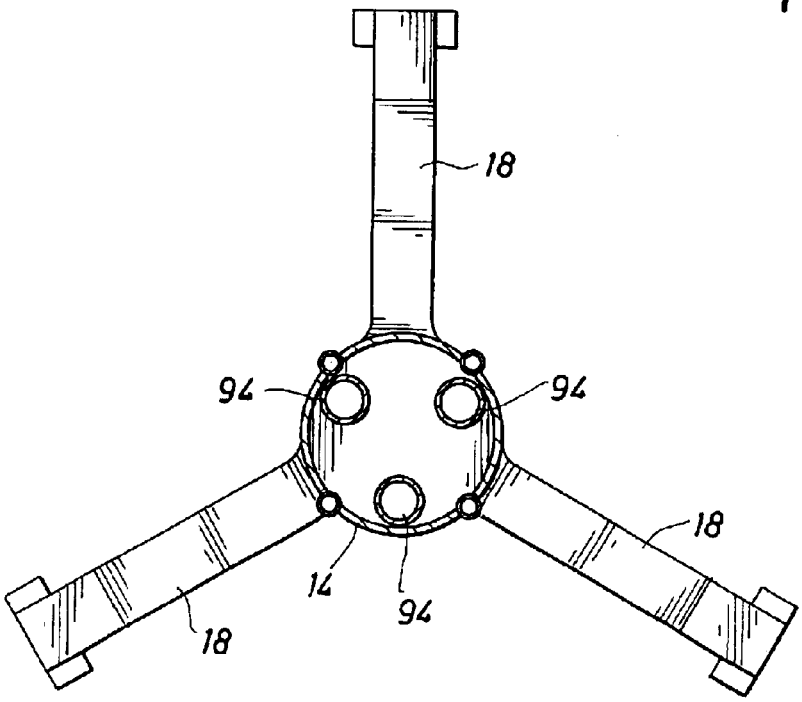

Referring now to FIGS. 7 and 8, an alternate embodiment of the oscillation suppression of the invention is depicted wherein a platform 60 includes an annular configuration of the oscillation suppression system incorporated into the structure of the platform hull. The oscillation suppression system comprises a vertical annular chamber 62 open at the bottom 63 and closed or partially vented at the top 65 thereof. The outer surface 64 of the annular chamber 62 may define the outer diameter of the platform hull. Integrating the annular chamber 62 into the hull structure of the platform 60 may result in fabrication cost savings and may make it possible to economically obtain a large capacity oscillation suppression system. The capacity of the oscillation suppression system may be altered by changing the external diameter of the platform hull, or the diameter of the inner wall 66 of the annular chamber 62.

Figure 9:
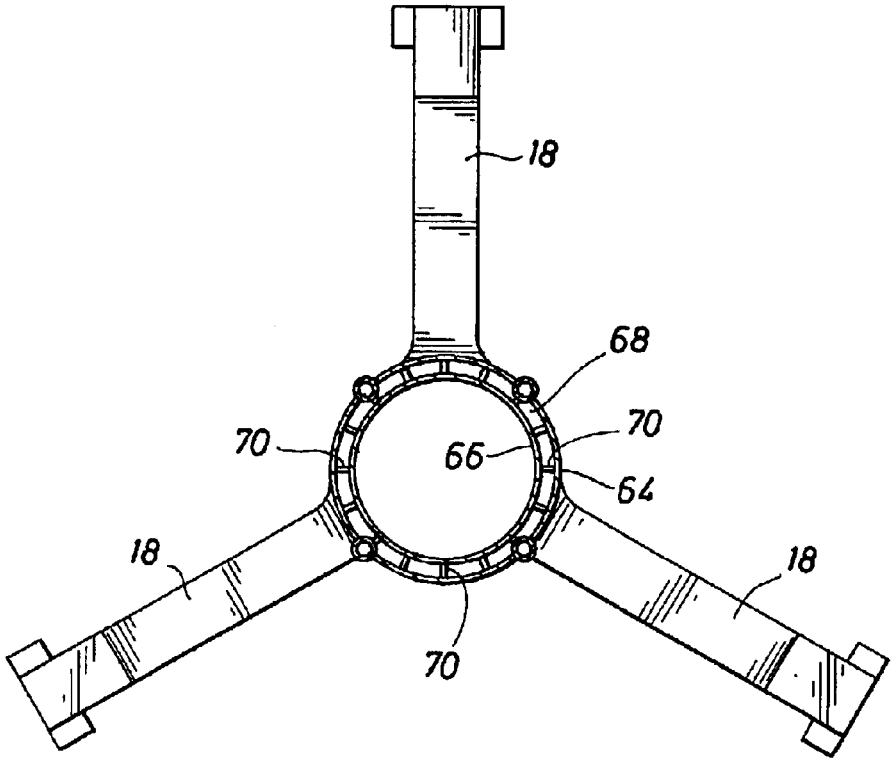
FIG. 9 is a section view of an alternate embodiment of the oscillation suppression system of the present invention depicting multiple energy absorption chambers incorporated in the hull of the floating platform.

The energy absorption characteristics of the annular chamber 62 may be altered further by partitioning the annular chamber 62 into multiple chambers 68 as shown in FIG. 9. The chambers 68 are formed by installing partitions 70 in the annular chamber 62 between the inner and outer surfaces 64 and 66 forming the annular chamber 62. Not all segments of the partitioned annular chamber 62 need be utilized for energy absorption chambers.

In FIGS. 10 and 11 an embodiment of the oscillation suppression system for a multi-column platform is shown. In this embodiment, the oscillation suppression system of the invention includes one or more energy absorbing chambers 82 mounted within the four columns 84 of a platform 80. The energy absorbing chambers 82 are preferably located within the columns 84. The upper ends of the absorbing chambers 82 are closed by plates 86 which secure the chambers 82 within the platform support columns 84. Flange plates 88 circumscribing the open lower ends of the chambers 82 close off the bottom ends of the platform support columns 84. The energy absorbing chambers 82 may also be attached to the outer surface of the platform columns 84 in a manner similar to that of the embodiment of the invention shown in FIG. 1 and described hereinabove.

Referring now to FIGS. 12–17, various alternate embodiments of the oscillation suppression system of the invention are shown which may be desired because of environmental and/or platform design criteria. The alternate oscillation suppression system configurations include spherical air spring chambers 90 (FIGS. 12 and 13), arcuate energy absorbing chambers 92 (FIGS. 14 and 15), and energy absorbing chambers 94 designed integral to a platform hull (FIGS. 16 and 17), or mounted in a moonpool of a platform.

Although the energy absorbing chambers shown in the figures and referred to in the discussion above are primarily referred to as single chambers, there may be vertical partitioning of any of the energy absorbing chambers to limit the horizontal extent of the free surface within a chamber. Vertical partitioning will prevent gravity waves from occurring, which may disrupt the dynamics of the oscillating mass. The vertical partitions may extend only near the water line, or extend up to the full length of the energy absorbing chambers.

In all cases, a gas or gases may be substituted for the use of air in the description of the invention above. Such gases, for example carbon dioxide or nitrogen, include elastic properties which fulfill the function of the air in the description of the invention, and may add other desirable qualities, such as better corrosion control or better control of pressure/volume behavior.

While various embodiments of the invention have been shown and described, other and further embodiments of the invention may be devised without departing from the basic scope thereof, and the scope thereof is determined by the claims that follow.

What is claimed is:

1. An oscillation suppression system for limiting natural resonance of a floating platform anchored in a body of water, comprising:

a) at least one support column having an upper portion extending above the water surface and a lower portion extending below the water surface, said at least one support column being adapted to support an equipment deck above the water surface; and b) one or more energy absorption chambers secured to said at least one support column and wherein said energy absorption chambers are dimensionally adapted for developing a natural frequency of oscillation nearly matching natural vertical and rotational oscillation frequencies of the floating platform.

2. The oscillation suppression system of claim 1 wherein said energy absorption chambers include an upper portion and a lower portion, and wherein said upper portion is closed and said lower portion is open.

3. The oscillation suppression system of claim 2 wherein said energy absorption chambers include a gas spring formed by enclosed gas in said upper portion of said energy absorption chambers and a water mass contained in said lower portion thereof.

4. The oscillation suppression system of claim 3 wherein said gas spring is formed by air in said upper portion of said energy absorption chambers.

5. The oscillation suppression system of claim 2 wherein said energy absorption chambers include means for controlled release of gas from said upper portion for adjusting the energy absorption characteristics thereof.

6. The oscillation suppression system of claim 2 wherein said energy absorption chambers include means for varying the turbulence of water movement in said energy absorption chambers for adjusting the energy absorption characteristics thereof.

7. The oscillation suppression system of claim 2 including baffle plates mounted in said lower portion of said energy absorption chambers.

8. The oscillation suppression system of claim 7 including a second set of baffle plates mounted in said upper portion of said energy absorption chambers.

9. The oscillation suppression system of claim 2 including baffle plates mounted in said upper portion of said energy absorption chambers.

10. The oscillation suppression system of claim 2 wherein said lower portion of said energy absorption chambers terminates in a sharp lower edge defining a sharp open entry to said lower portion of said energy absorption chambers.

11. The oscillation suppression system of claim 2 wherein said lower portion of said energy absorption chambers terminates in a flared lower edge defining a smooth open entry to said lower portion of said energy absorption chambers.

12. The oscillation suppression system of claim 2 including vertical partitions within said energy absorption chambers.

13. The oscillation suppression system of claim 2 wherein said upper portion of said energy absorption chambers has a diameter larger than said lower portion thereof.

14. The oscillation suppression system of claim 2 wherein said upper portion of said energy absorption chambers is spherical.

15. The oscillation suppression system of claim 2 wherein said upper portion of said energy absorption chambers is prismatic.

16. The oscillation suppression system of claim 2 wherein said energy absorption chambers define an arc segment profile corresponding to the curvature of said support column.

17. The oscillation suppression system of claim 1 wherein said support column includes an annular energy absorption chamber defining an external surface thereof.

18. The oscillation suppression system of claim 17 wherein said annular energy absorption chamber includes spaced axial partitions extending the axial length of said annular energy absorption chamber forming multiple energy absorption chambers therein.

19. The oscillation suppression system of claim 1 wherein said platform includes multiple support columns and an energy absorption chamber secured to one or more of said support columns.

20. The oscillation suppression system of claim 1 including means for adjusting the energy absorption characteristics of said energy absorption chambers.

21. The oscillation suppression system of claim 1 wherein said energy absorption chambers are constructed integral to said at least one support column.

22. The oscillation suppression system of claim 1 wherein said energy absorption chambers are mounted on said support column within a moonpool extending through said support column.

23. In a deep water offshore apparatus for use in oil drilling and production, the combination of:

c) a platform having a hull means adapted to support the weight of the platform by buoyancy;

d) energy absorption means secured to said hull means for achieving a selected natural resonant period for said apparatus, said energy absorption means including means for adjusting the energy absorption characteristics thereof; and e) anchor and tendon system means connected to said apparatus for securing said apparatus to the sea bottom.

24. The apparatus of claim 23 wherein said energy absorption means comprises at least one chamber having a spring formed by enclosed gas in an upper portion of said chamber and a water mass contained in a lower portion of said chambers.

25. The apparatus of claim 24 wherein said means for adjusting the energy absorption characteristics of said chamber includes vent means mounted on said chambers.

26. The apparatus of claim 25 wherein said vent means comprises a control valve mounted on said upper portion of said chambers.

27. The apparatus of claim 25 wherein said vent means comprises an orifice in said upper portion of said chambers.

28. An apparatus for minimizing heave, pitch, and roll motions of a buoyant offshore structure, comprising:

a) energy absorption means including at least one chamber secured to a column of said structure, wherein said column is partially submerged in the sea;

b) said chambers including a gas spring formed in an upper portion of said chambers and a water mass contained in a lower portion of said chambers, and wherein said energy absorption chamber are dimensionally adapted for developing a natural frequency of oscillation nearly marching natural vertical and rotational oscillation frequencies of the floating platform;

c) wherein said chambers include means for adjusting the energy absorption characteristics of said chambers; and d) anchor and tendon system means connected to said structure for securing said structure to the sea bottom.

29. The apparatus of claim 28 including vent means for controlled release of gas from said upper portion of said chambers for controlling the energy absorption oscillator damping characteristics of said energy absorption means.

* * * * *